US010738529B1

(12) United States Patent
Daley

(10) Patent No.: US 10,738,529 B1
(45) Date of Patent: Aug. 11, 2020

(54) MODULAR, RETRACTABLE BARRIER

(71) Applicant: Nicole Daley, Phoenix, AZ (US)

(72) Inventor: Nicole Daley, Phoenix, AZ (US)

( * ) Notice: Subject to any disclaimer, the term of this patent is extended or adjusted under 35 U.S.C. 154(b) by 643 days.

(21) Appl. No.: 15/614,750

(22) Filed: Jun. 6, 2017

(51) Int. Cl.

| | |
|---|---|
| ***E06B 9/172*** | (2006.01) |
| ***E04H 4/10*** | (2006.01) |
| ***E04B 2/42*** | (2006.01) |
| ***E04B 2/02*** | (2006.01) |
| ***E06B 9/00*** | (2006.01) |

(52) U.S. Cl.
CPC ..... *E06B 9/172* (2013.01); *E04B 2/02* (2013.01); *E04B 2/42* (2013.01); *E04H 4/101* (2013.01); *E04B 2002/0256* (2013.01); *E06B 2009/002* (2013.01)

(58) Field of Classification Search
CPC ..... E04B 2/02; E04B 2009/002; E06B 9/08; E01F 13/028
See application file for complete search history.

(56) References Cited

U.S. PATENT DOCUMENTS

| | | | | |
|---|---|---|---|---|
| 5,636,679 | A | 6/1997 | Miller | |
| 5,660,144 | A | 8/1997 | Venti | |
| 6,056,038 | A | 5/2000 | Foster | |
| 6,536,502 | B2 | 3/2003 | Britto | |
| 6,575,435 | B1 | 6/2003 | Kotzen | |
| 6,807,999 | B1 * | 10/2004 | Bowen | E01F 13/028 160/24 |
| 7,207,370 | B2 | 4/2007 | Snyder | |
| 7,219,709 | B1 | 5/2007 | Williams | |
| 7,377,490 | B1 * | 5/2008 | Khosravian | E01F 13/028 119/416 |
| 8,887,441 | B2 | 11/2014 | Lundh | |
| 9,714,491 | B2 * | 7/2017 | Wettern | E01F 13/022 |
| 2003/0164485 | A1 * | 9/2003 | Olson | B21F 33/002 256/37 |
| 2005/0098770 | A1 * | 5/2005 | Schell | E01F 13/028 256/25 |
| 2006/0151123 | A1 * | 7/2006 | Chandler | E01F 13/028 160/24 |
| 2007/0193705 | A1 * | 8/2007 | Hsu | A47G 5/02 160/238 |
| 2010/0181030 | A1 * | 7/2010 | Smoyer | A47G 5/02 160/290.1 |

(Continued)

FOREIGN PATENT DOCUMENTS

| | | |
|---|---|---|
| CN | 102066676 | 9/2013 |

*Primary Examiner* — Jonathan P Masinick
(74) *Attorney, Agent, or Firm* — Kyle A. Fletcher, Esq.

(57) ABSTRACT

The modular, retractable barrier is a room partition. The modular, retractable barrier comprises one or more barrier structures. Each of the one or more barrier structures comprises a plurality of scroll rods and a mesh barrier. The mesh barrier is a scroll like structure. When each of the plurality of scroll rods is separated the mesh barrier is deployed in the space between each of the plurality of scroll rods to form a barricade structure. When the plurality of scroll rods is later brought together, the mesh barrier is retracted. The modular, retractable barrier is a modular structure wherein any first barrier structure selected from the one or more barrier structures can be removably attached to any second barrier structure selected from the one or more barrier structures such that overall span of the barricade formed by the modular, retractable barrier can be increased.

20 Claims, 4 Drawing Sheets

(56) References Cited

U.S. PATENT DOCUMENTS

| | | | | |
|---|---|---|---|---|
| 2018/0044868 | A1* | 2/2018 | Miller | E01F 13/028 |
| 2019/0063018 | A1* | 2/2019 | Reiner | B65H 75/4471 |
| 2019/0218854 | A1* | 7/2019 | Fusco | E06B 9/13 |
| 2020/0024862 | A1* | 1/2020 | Bianchi | E04H 15/003 |

* cited by examiner

MODULAR, RETRACTABLE BARRIER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of building and building construction including furniture and household equipment, more specifically, a movable room partition.

SUMMARY OF INVENTION

The modular, retractable barrier is a room partition. The modular, retractable barrier is configured for use as a barricade that divides the room. The modular, retractable barrier comprises one or more barrier structures. Each of the one or more barrier structures comprises a plurality of scroll rods and a mesh barrier. The mesh barrier is arranged in a scroll like structure. Specifically, the mesh barrier is rolled around each of the plurality of scroll rods such that when each of the plurality of scroll rods are separated the mesh barrier is deployed in the space between each of the plurality of scroll rods to form the barricade structure. When the plurality of scroll rods is later brought together, the mesh barrier is retracted. The modular, retractable barrier is a modular structure wherein any first barrier structure selected from the one or more barrier structures can be removably attached to any second barrier structure selected from the one or more barrier structures such that overall span of the barricade formed by the modular, retractable barrier can be increased.

These together with additional objects, features and advantages of the modular, retractable barrier will be readily apparent to those of ordinary skill in the art upon reading the following detailed description of the presently preferred, but nonetheless illustrative, embodiments when taken in conjunction with the accompanying drawings.

In this respect, before explaining the current embodiments of the modular, retractable barrier in detail, it is to be understood that the modular, retractable barrier is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the modular, retractable barrier.

It is therefore important that the claims be regarded as including such equivalent construction insofar as they do not depart from the spirit and scope of the modular, retractable barrier. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
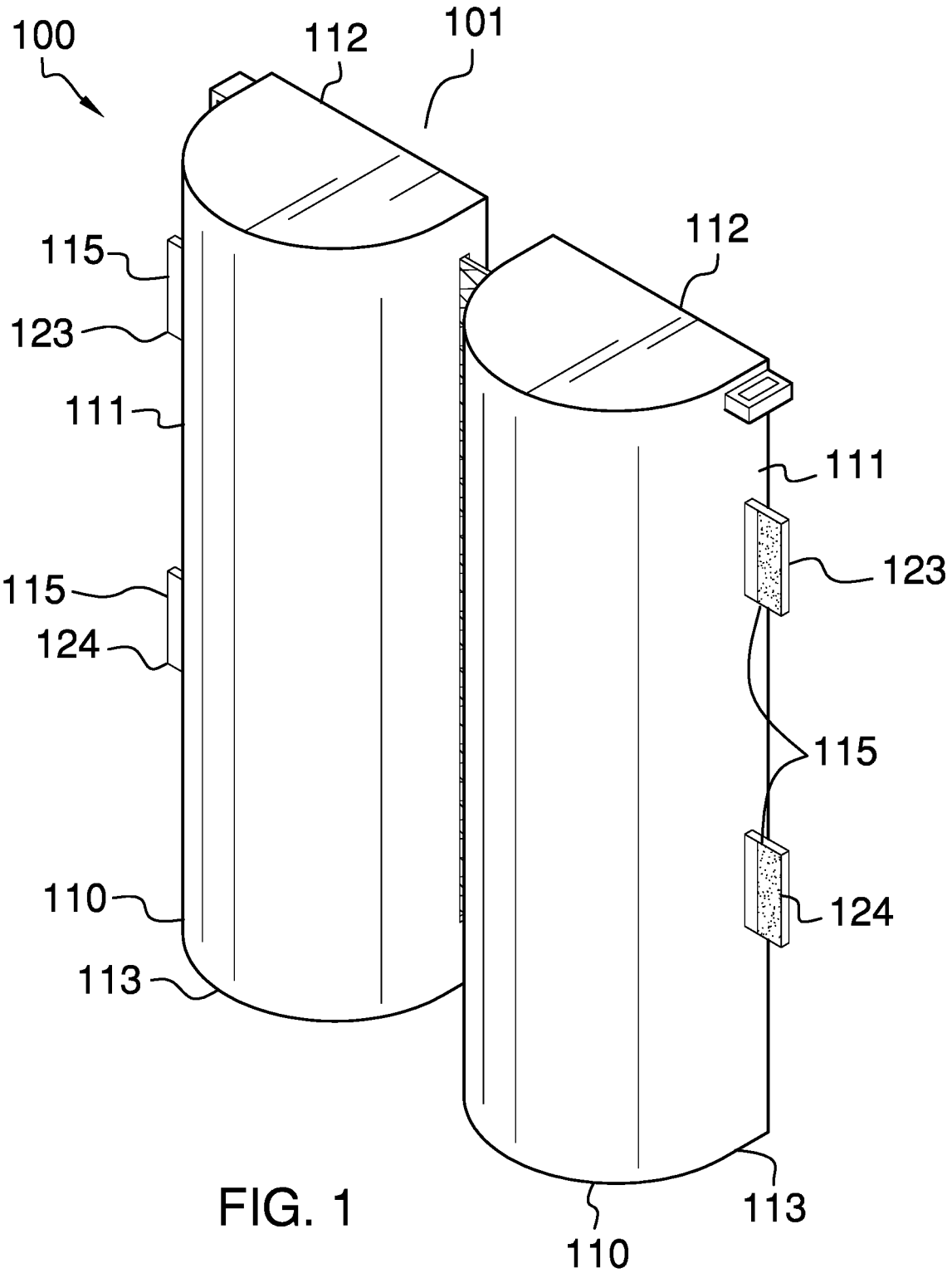
FIG. 1 is a perspective view of an embodiment of the disclosure.
Figure 2:
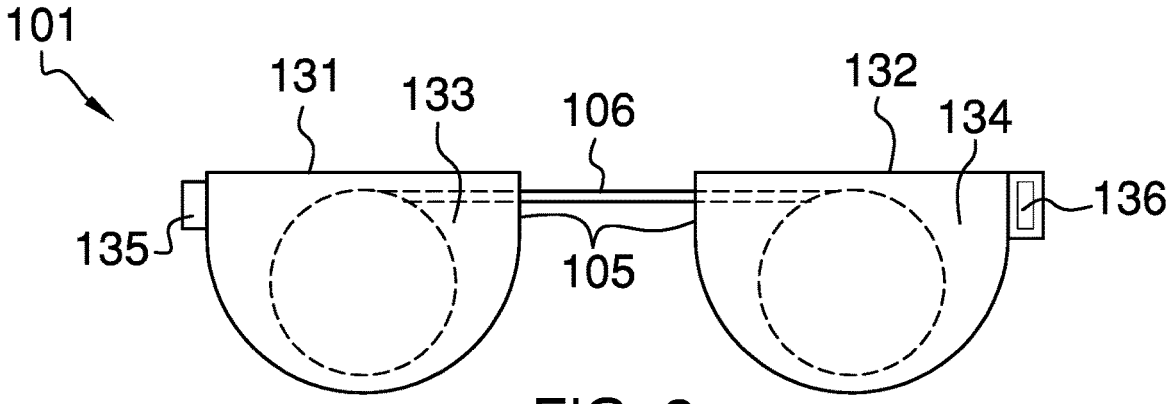
FIG. 2 is a top view of an embodiment of the disclosure.
Figure 3:
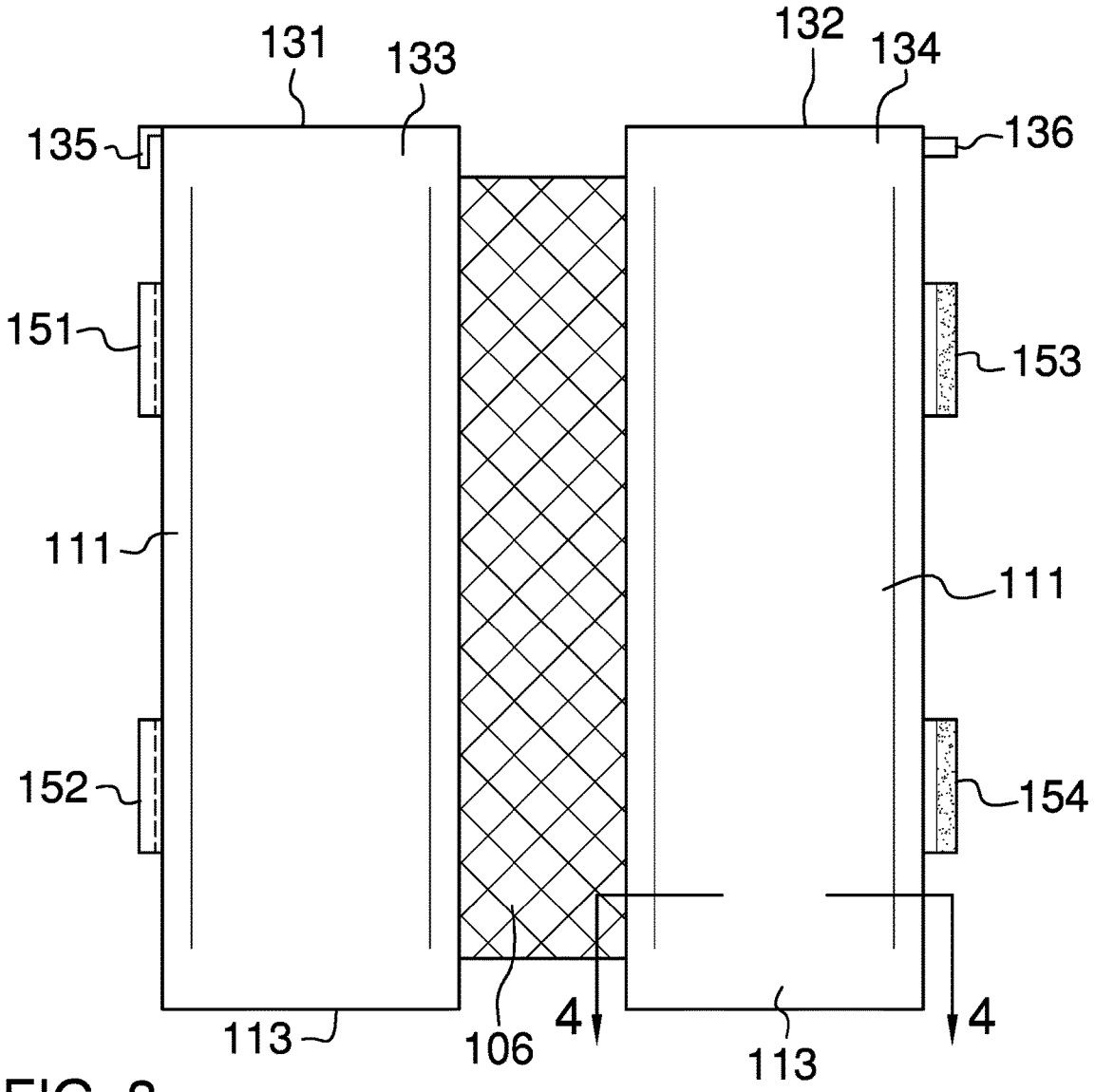
FIG. 3 is a front view of an embodiment of the disclosure.
Figure 4:
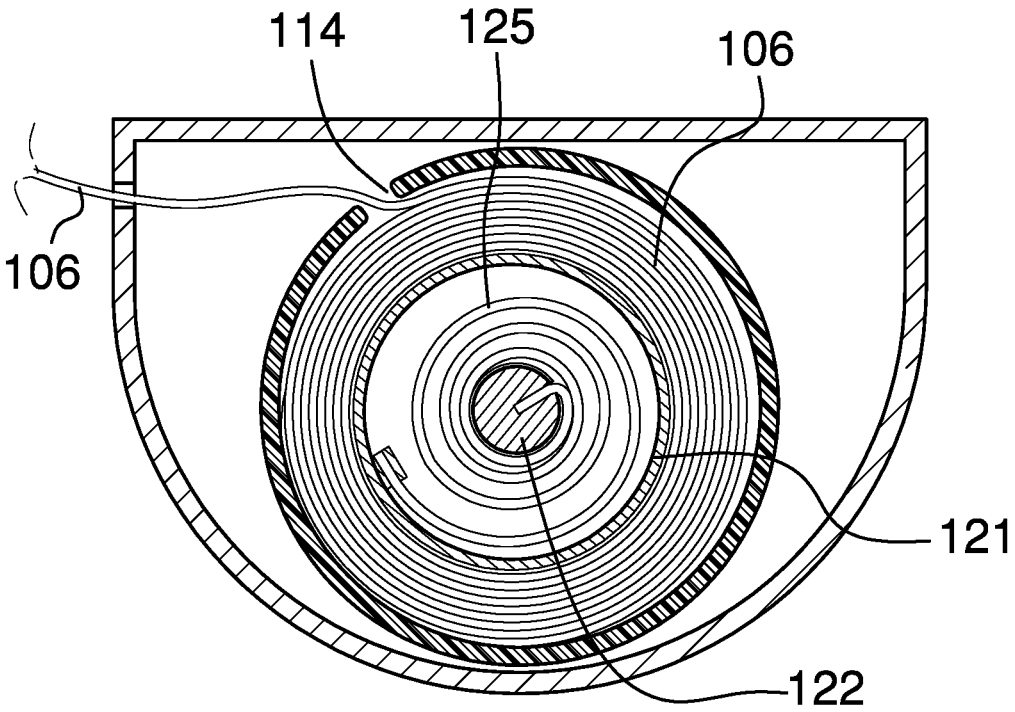
FIG. 4 is a cross-sectional view of an embodiment of the disclosure across 4-4 as shown in FIG. 3.
Figure 5:
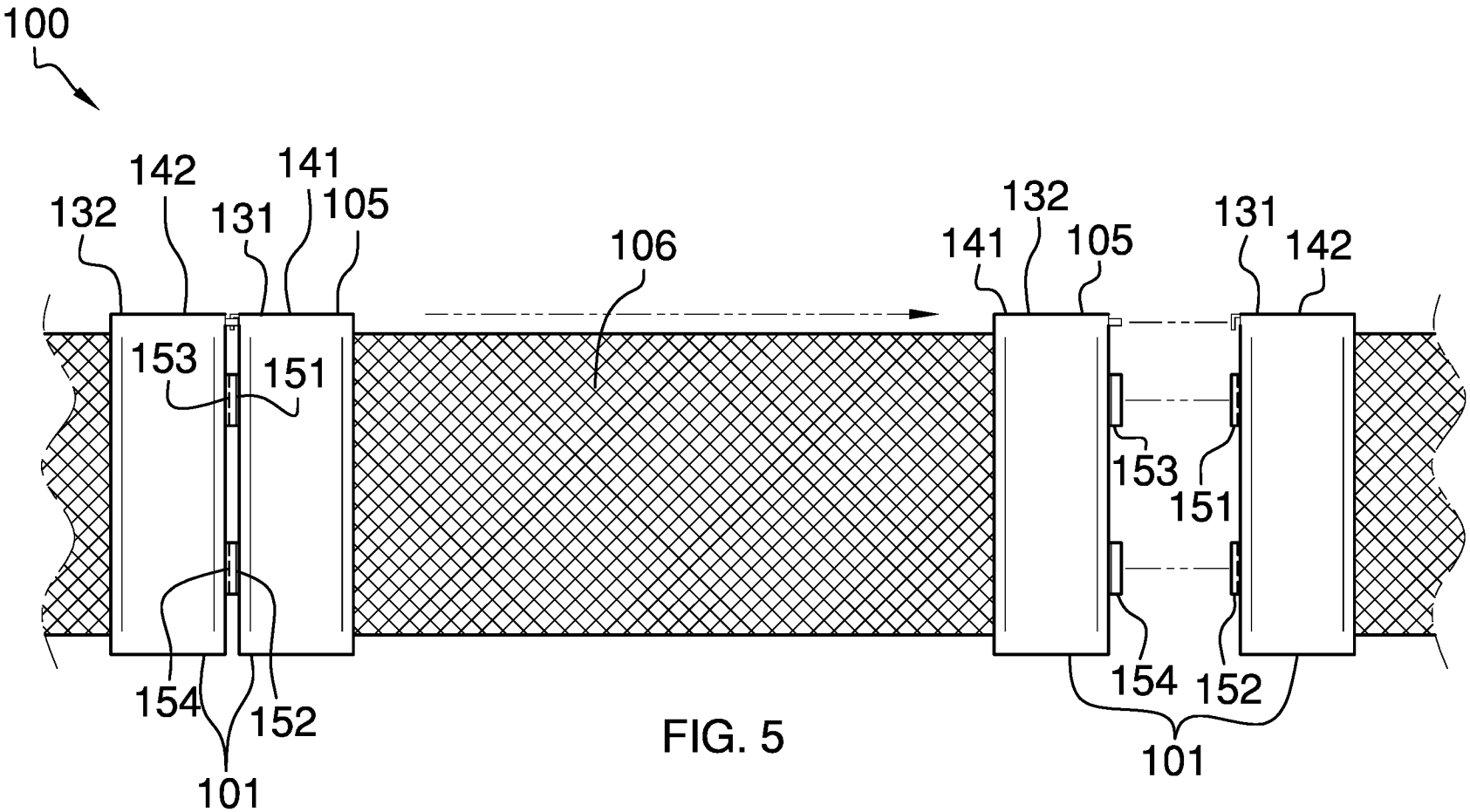
FIG. 5 is an in use view of an embodiment of the disclosure.

Detailed reference will now be made to one or more potential embodiments of the disclosure, which are illustrated in FIGS. 1 through 5.

The modular, retractable barrier 100 (hereinafter invention) is a room partition. The invention 100 is configured for use as a barricade that divides the room. The invention 100 comprises one or more barrier structures 101. Each of the one or more barrier structures 101 comprises a plurality of scroll rods 105 and a mesh barrier 106. The mesh barrier 106 is arranged in a scroll like structure. Specifically, the mesh barrier 106 is rolled around each of the plurality of scroll rods 105 such that when each of the plurality of scroll rods 105 are separated the mesh barrier 106 is deployed in the space between each of the plurality of scroll rods 105 to form the barricade structure. When the plurality of scroll rods 105 are later brought together, the mesh barrier 106 is retracted. The invention 100 is a modular structure wherein any first barrier structure 141 selected from the one or more barrier structures 101 can be removably attached to any second barrier structure 142 selected from the one or more barrier structures 101 such that overall span of the barricade formed by the invention 100 can be increased.

Each of the one or more barrier structures 101 is an integrated unit that, by itself, is capable of partitioning a room. Any first barrier structure 141 selected from the one or more barrier structures 101 can be attached to any second barrier structure 142 selected from the one or more barrier structures 101 such that the overall span formed by the one or more barrier structures 101 can be increased.

Each of the one or more barrier structures 101 comprises a plurality of scroll rods 105 and a mesh barrier 106. The mesh barrier 106 is a readily and commercially available rectangular mesh textile. The mesh barrier 106 forms the physical barricade that is used to partition a room. The mesh barrier 106 is rolled around each of the plurality of scroll rods 105 in the manner of a scroll. This scrolled structure allows the mesh barrier 106 to be deployed and retracted as required.

The plurality of scroll rods 105 is a collection of individual scroll rods 110. Each of the plurality of scroll rods 105 forms an end of the selected barrier structure. The individual scroll rod 110 forms an end of the barricade created by a barrier structure selected from the one or more barrier structures 101. The mesh barrier 106 attaches to and, as described elsewhere in this disclosure, is rolled into the individual scroll rod 110.

Each of the plurality of scroll rods 105 comprises a collection of individual scroll rods 110. Each individual scroll rod 110 comprises a semi-cylindrical tube 111, a superior base 112, an inferior base 113, a face slot 114, and a plurality of fasteners 115.

The semi-cylindrical tube 111 is a bifurcated cylindrical shaped hollow housing structure. The bifurcation of the semi-cylindrical tube 111 follows along the center axis of the cylinder that forms the semi-cylindrical tube 111. The mesh barrier 106 is retracted into the semi-cylindrical tube 111 for storage. The superior base 112 is a plate structure that is attached to the superior base 112 of the semi-cylindrical tube 111. The superior base 112 of the semi-cylindrical tube 111 is the base of the semi-cylindrical tube 111 that is distal from the inferior base 113. The inferior base 113 is a plate structure that is attached to the inferior base 113 of the semi-cylindrical tube 111. The inferior base 113 is a supporting structure that is placed upon a horizontal surface when the invention 100 is in use. The face slot 114 is a slot that is formed in the face of the semi-cylindrical tube 111 of the individual scroll rod 110. The mesh barrier 106 is deployed through and retracted into the semi-cylindrical tube 111 through the face slot 114.

The semi-cylindrical tube 111 further comprises a spool 121 and a reel 122. The spool 121 is a rotating cylindrical device upon which the mesh barrier 106 is rolled. Specifically, an edge of the mesh barrier 106 is physically attached to the spool 121 such that the mesh barrier 106 can be rolled onto or off of the spool 121. The reel 122 is a mechanical device that uses the potential energy stored within a spring 125 to rotate the spool 121 in a manner that will retract the mesh barrier 106. The reel 122 described in this disclosure is commercially available. Such reels are well known and documented in the mechanical arts. The spring 125 is a mechanical device that is used for storing mechanical potential energy. The mechanical potential energy stored within the spring 125 is used to power the reel 122 to retract the mesh barrier 106. The design and use of springs 125 is well known and documented in the mechanical arts.

Each of the plurality of fasteners 115 is a readily and commercially available fastener. The plurality of fasteners 115 associated with any first scroll rod 131 selected from the plurality of scroll rods 105 selected from a first barrier structure 141 selected from the one or more barrier structures 101 is identical to the plurality of fasteners 115 associated with any second scroll rod 132 selected from the plurality of scroll rods 105 selected from a second barrier structure 142 selected from the one or more barrier structures 101. In this configuration the plurality of fasteners 115 will attach any first barrier structure 141 selected from the one or more barrier structures 101 to any second barrier structure 142 selected from the one or more barrier structures 101.

Each of the plurality of fasteners 115 comprises a superior connector 123 and an inferior connector 124. The superior connector 123 is first connector 151 selected from a fastener associated with the plurality of fasteners 115. The superior connector 123 is attached to the face of the semi-cylindrical tube 111 of an individual scroll rod 110 such that the superior connector 123 is proximal to the superior base 112 relative to the inferior connector 124. The inferior connector 124 is second connector 152 selected from a fastener associated with the plurality of fasteners 115. The inferior connector 124 is attached to the face of the semi-cylindrical tube 111 of an individual scroll rod 110 such that the inferior connector 124 is proximal to the inferior base 113 relative to the superior base 112. The superior connector 123 and the inferior connector 124 are matched such that the superior connector 123 will attach to the inferior connector 124 of any given individual scroll rod 110. All the superior connectors 123 contained within the invention 100 are identical. All the inferior connectors 124 contained within the invention 100 are identical.

In the first potential embodiment of the disclosure it is preferred that each of the plurality of fasteners 115 be selected from the group consisting of a quick release buckle or a hook and loop fastener.

In the first potential embodiment of the disclosure, the plurality of scroll rods 105 comprises a first scroll rod 131 and a second scroll rod 132. The first scroll rod 131 is further defined with a first superior base 133. The first superior base 133 is the superior base 112 of the first scroll rod 131. The second scroll rod 132 is further defined with a second superior base 134. The second superior base 134 is the superior base 112 of the second scroll rod 132.

The first scroll rod 131 is a first individual scroll rod 110 selected from the plurality of scroll rods 105. A first end of the mesh barrier 106 attaches to the spool 121 of the first scroll rod 131. The second scroll rod 132 is a second individual scroll rod 110 selected from the plurality of scroll rods 105. A second end of the mesh barrier 106 attaches to the spool 121 of the second scroll rod 132.

The first superior base 133 comprises a latch clip 135. The latch clip 135 is a hook like device that is formed on the first superior base 133. Each latch clip 135 contained within the invention 100 is identical. The second superior base 134 comprises a latch notch 136. The latch notch 136 is an aperture associated with the second superior base 134. The latch notch 136 is an aperture that is formed in a location selected from the group consisting of: 1) within the second superior base 134; or, 2) attached to the second superior base 134. Each latch notch 136 contained within the invention 100 is identical. Each latch notch 136 is sized such that any latch clip 135 can be attached to any latch notch 136.

In the first potential embodiment of the disclosure, the one or more barrier structures 101 comprises a first barrier structure 141 and a second barrier structure 142. The plurality of fasteners 115 further comprises a first connector 151, a second connector 152, a third connector 153, and a fourth connector 154.

The first connector 151 is the superior connector 123 of the first scroll rod 131 of a selected barrier structure. The second connector 152 is the inferior connector 124 of the first scroll rod 131 of a selected barrier structure. The third connector 153 is the superior connector 123 of the second scroll rod 132 of a selected barrier structure. The fourth connector 154 is the inferior connector 124 of the second scroll rod 132 of a selected barrier structure.

The third connector 153 is selected such that the third connector 153 of any first barrier structure 141 selected from the one or more barrier structures 101 will attach to the first connector 151 of any second barrier structure 142 selected from the one or more barrier structures 101. The fourth connector 154 is selected such that the fourth connector 154 of any first barrier structure 141 selected from the one or more barrier structures 101 will attach to the second connector 152 of any second barrier structure 142 selected from the one or more barrier structures 101.

The attachment of the first barrier structure 141 to the second barrier structure 142 is completed by attaching the latch clip 135 of the first scroll rod 131 of the first barrier structure 141 to the latch notch 136 of the second scroll rod 132 of the second barrier structure 142.

The following definitions were used in this disclosure:

Buckle: As used in this disclosure, a buckle is a fastening that is used for joining a first loose end of a strap to a second loose end of the same strap or a different strap. A buckle further comprises a male connector that is attached to a first loose end and a female connector that is attached to a second loose end. The male connector has a pin or other structure that is generally caught by a structure formed in the female connector.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Center of Rotation: As used in this disclosure, the center of rotation is the point of a rotating plane that does not move with the rotation of the plane. A line within a rotating three dimensional object that does not move with the rotation of the object is referred to as an axis of rotation.

Clip: As used in this disclosure, a clip is a fastener that attaches to an object by gripping or clasping the object.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. In this disclosure, the term cylinder specifically means a right cylinder, which is defined as a cylinder wherein the curved surface perpendicularly intersects with the two identical flat and parallel ends.

Exterior: As used in this disclosure, the exterior is use as a relational term that implies that an object is not contained within the boundary of a structure or a space.

Fastener: As used in this disclosure, a fastener is a device that is used to join or affix two objects. Fasteners generally comprise a first element, which is attached to the first object and a second element which is attached to the second object such that the first element and the second element join to affix the first object and the second object. Common fasteners include, but are not limited to, zippers, snaps, buttons, buckles, quick release buckles, or hook and loop fasteners.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook or loop surface" with the understanding that when the two objects are fastened together one of the two objects will have a hook surface and the remaining object will have the loop surface.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Housing: As used in this disclosure, a housing is a casing that encloses and protects one or more devices.

Inferior: As used in this disclosure, the term inferior refers to a directional reference that is parallel to and in the same direction as the force of gravity.

Interior: As used in this disclosure, the interior is use as a relational term that implies that an object is contained within the boundary of a structure or a space.

Latch: As used in this disclosure, a latch is a fastening or locking mechanism. The use of the term latch does not necessarily but often implies the insertion of an object into a notch or cavity.

Mesh: As used in this disclosure, the term mesh refers to an openwork fabric made from threads, yarns, cords, wires, or lines that are woven, knotted, or otherwise twisted or intertwined at regular intervals. Synonyms for mesh include net.

Notch: As used in this disclosure, a notch is: 1) an indentation formed in an edge; or 2) a cavity or aperture formed within a surface.

Plate: As used in this disclosure, a plate is a smooth, flat and semi-rigid or rigid structure that has at least one dimension that: 1) is of uniform thickness; and 2) that appears thin relative to the other dimensions of the object. Plates often have a rectangular or disk like appearance. As defined in this disclosure, plates may be made of any material, but are commonly made of metal.

Quick Release Buckle: As used in this disclosure, a quick release buckle is a specific type of buckle wherein the buckle can be readily and easily disconnected by pressing a button or pinching one of the ends of the quick release buckle. Quick release buckles are readily and commercially available.

Roll: As used in this disclosure, a roll is a method of storing paper or other sheeting in a cylindrical structure such that creases are not formed within the paper or sheeting. To form the roll, the paper or other sheeting material is curved over itself around a center axis such that a spiral is formed when the roll is viewed from the end of the cylindrical structure.

Sheeting: As used in this disclosure, sheeting is a material, such as a textile, a plastic, or a metal foil, in the form of a thin flexible layer or layers.

Slot: As used in this disclosure, a slot is a long narrow groove or aperture that is formed in an object.

Spool: As used in this disclosure, a spool is a cylindrical device upon which a flexible material, including but not limited to a yarn, a cord, or a tape, can be wound. Depending on context, a spool may also contain the flexible material stored upon the spool.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

Superior: As used in this disclosure, the term superior refers to a directional reference that is parallel to and in the opposite direction of the force of gravity.

Textile: As used in this disclosure, a textile is a material that is woven, knitted, braided or felted. Synonyms in common usage for this definition include fabric and cloth.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A partition comprising:

one or more barrier structures;

wherein each of the one or more barrier structures comprises a plurality of scroll rods and a mesh barrier;

wherein the mesh barrier is arranged in a scroll like structure;

wherein the mesh barrier is rolled around each of the plurality of scroll rods such that when each of the plurality of scroll rods are separated the mesh barrier is deployed in the space between each of the plurality of scroll rods to form the barricade structure;

wherein when the plurality of scroll rods are brought together the mesh barrier is retracted;

wherein the partition is configured for use as a barricade;

wherein each of the one or more barrier structures is an integrated unit that is capable of partitioning a room;

wherein the partition is a modular structure;

wherein any first barrier structure selected from the one or more barrier structures can be removably attached to any second barrier structure selected from the one or more barrier structures.

2. The partition according to claim 1 wherein the mesh barrier is a rectangular mesh.

3. The partition according to claim 2 wherein each of the plurality of scroll rods comprises a collection of individual scroll rods;

wherein each individual scroll rod forms an end of the barricade created by a barrier structure selected from the one or more barrier structures;

wherein the mesh barrier attaches to and is rolled into the individual scroll rod.

4. The partition according to claim 3 wherein each individual scroll rod comprises a semi-cylindrical tube, a superior base, an inferior base, a face slot, and a plurality of fasteners;

wherein the superior base, the inferior base and the plurality of fasteners are attached to the individual scroll rod;

wherein the face slot is formed in the individual scroll rod.

5. The partition according to claim 4 wherein the semi-cylindrical tube is a bifurcated cylindrically shaped hollow housing structure;

wherein the mesh barrier is retracted into the semi-cylindrical tube;

wherein the superior base is a plate structure that is attached to the semi-cylindrical tube;

wherein the superior base of the semi-cylindrical tube is the base of the semi-cylindrical tube that is distal from the inferior base;

wherein the inferior base is a plate structure that is attached to the inferior base of the semi-cylindrical tube;

wherein the inferior base is a supporting structure that is placed upon a horizontal surface when the partition is in use.

6. The partition according to claim 5 wherein the face slot is a slot that is formed in the face of the semi-cylindrical tube of the individual scroll rod;

wherein the mesh barrier is deployed through and retracted into the semi-cylindrical tube through the face slot.

7. The partition according to claim 6 wherein the semi-cylindrical tube further comprises a spool;

wherein the spool is a rotating cylindrical device upon which the mesh barrier is rolled;

wherein an edge of the mesh barrier is physically attached to the spool such that the mesh barrier can be rolled onto or off of the spool.

8. The partition according to claim 7 wherein the semi-cylindrical tube further comprises a reel;

wherein the reel is a mechanical device;

wherein the reel further comprises a spring;

wherein the reel uses the potential energy stored within the spring to rotate the spool in a manner that will retract the mesh barrier.

9. The partition according to claim 8 wherein the plurality of fasteners associated with any first scroll rod selected from the plurality of scroll rods selected from a first barrier structure selected from the one or more barrier structures is identical to the plurality of fasteners associated with any second scroll rod selected from the plurality of scroll rods selected from a second barrier structure selected from the one or more barrier structures.

10. The partition according to claim 9 wherein the plurality of fasteners attach any first barrier structure selected from the one or more barrier structures to any second barrier structure selected from the one or more barrier structures.

11. The partition according to claim 10 wherein each of the plurality of fasteners comprises a superior connector and an inferior connector;

wherein the superior connector is a first connector selected from a fastener associated with the plurality of fasteners;

wherein the superior connector is attached to the face of the semi-cylindrical tube of an individual scroll rod such that the superior connector is proximal to the superior base relative to the inferior connector;

wherein the inferior connector is a second connector selected from a fastener associated with the plurality of fasteners;

wherein the inferior connector is attached to the face of the semi-cylindrical tube of an individual scroll rod such that the inferior connector is proximal to the inferior base relative to the superior base.

12. The partition according to claim 11 wherein the superior connector and the inferior connector are matched such that the superior connector will attach to the inferior connector of any given individual scroll rod.

13. The partition according to claim 12 wherein all the superior connectors contained within the partition are identical;

wherein all the inferior connectors contained within the partition are identical.

14. The partition according to claim 13 wherein the plurality of scroll rods comprises a first scroll rod and a second scroll rod;

wherein the first scroll rod is a first individual scroll rod selected from the plurality of scroll rods;

wherein the second scroll rod is a second individual scroll rod selected from the plurality of scroll rods;

wherein the first scroll rod is further defined with a first superior base;

wherein the first superior base is the superior base of the first scroll rod;

wherein the second scroll rod is further defined with a second superior base;

wherein the second superior base is the superior base of the second scroll rod;

wherein a first end of the mesh barrier attaches to the spool of the first scroll rod;

wherein a second end of the mesh barrier attaches to the spool of the second scroll rod.

15. The partition according to claim 14 wherein the first superior base comprises a latch clip;

wherein the latch clip is a hook like device that is formed on the first superior base;

wherein each latch clip contained within the partition is identical.

16. The partition according to claim 15 wherein the second superior base comprises a latch notch;

wherein the latch notch is an aperture associated with the second superior base;

wherein each latch notch contained within the partition is identical;

wherein each latch notch is sized such that any latch clip can be attached to any latch notch.

17. The partition according to claim 16 wherein the plurality of fasteners further comprises a first connector, a second connector, a third connector, and a fourth connector;

wherein the first connector is the superior connector of the first scroll rod of a selected barrier structure;

wherein the second connector is the inferior connector of the first scroll rod of a selected barrier structure;

wherein the third connector is the superior connector of the second scroll rod of a selected barrier structure;

wherein the fourth connector is the inferior connector of the second scroll rod of a selected barrier structure;

wherein the third connector is selected such that the third connector of any first barrier structure selected from the one or more barrier structures will attach to the first connector of any second barrier structure selected from the one or more barrier structures;

wherein the fourth connector is selected such that the fourth connector of any first barrier structure selected from the one or more barrier structures will attach to the second connector of any second barrier structure selected from the one or more barrier structures.

18. The partition according to claim 17 wherein the one or more barrier structures comprises a first barrier structure and a second barrier structure;

wherein the attachment of the first barrier structure to the second barrier structure is completed by attaching the latch clip of the first scroll rod of the first barrier structure to the latch notch of the second scroll rod of the second barrier structure.

19. The partition according to claim 18 wherein each of the plurality of fasteners is a quick release buckle.

20. The partition according to claim 18 wherein each of the plurality of fasteners is a hook and loop fastener.

* * * * *